US009765767B2

(12) United States Patent
Griffin et al.

(10) Patent No.: US 9,765,767 B2
(45) Date of Patent: Sep. 19, 2017

(54) SYNTHETIC VACUUM GENERATOR

(71) Applicant: The Boeing Company, Chicago, IL (US)

(72) Inventors: Steven F. Griffin, Kihei, HI (US); Christopher R. Shurilla, Kihei, HI (US)

(73) Assignee: The Boeing Company, Chicago, IL (US)

( * ) Notice: Subject to any disclaimer, the term of this patent is extended or adjusted under 35 U.S.C. 154(b) by 308 days.

(21) Appl. No.: 14/709,311

(22) Filed: May 11, 2015

(65) Prior Publication Data

US 2016/0333871 A1 Nov. 17, 2016

(51) Int. Cl.

| | |
|---|---|
| ***F04B 37/14*** | (2006.01) |
| ***F04B 35/04*** | (2006.01) |
| ***F04B 39/10*** | (2006.01) |
| ***F04B 43/09*** | (2006.01) |

(52) U.S. Cl.

CPC ..... *F04B 37/14* (2013.01); *F04B 35/04* (2013.01); *F04B 39/10* (2013.01); *F04B 43/095* (2013.01)

(58) Field of Classification Search

CPC ..... F04B 37/14; F04B 35/04; F04B 39/10; F04B 43/095; F04B 43/0018; F04B 43/0054; F04B 43/025; F04B 43/026; F04B 43/04; F04B 43/043; F04B 43/046; F04B 45/04; F04B 45/047; B64C 23/04; B64C 2230/02; B64C 2230/04; B64C 2230/06; B64C 2230/18; B64C 2230/28; B64C 2027/725; B64C 21/04; B64C 21/08; B64C 2230/14; B64C 2230/22; B64C 23/005; B64C 27/001; B64C 27/467

USPC ..... 417/412, 413.1, 413.2, 322, 399, 427, 417/540, 559; 239/102.1, 102.2; 244/130, 204, 207, 203, 204.1

See application file for complete search history.

(56) References Cited

U.S. PATENT DOCUMENTS

| | | | | |
|---|---|---|---|---|
| 3,800,762 | A * | 4/1974 | McCullough | F02M 1/10 261/39.1 |
| 5,957,413 | A * | 9/1999 | Glezer | B64C 21/08 244/208 |
| 6,092,990 | A * | 7/2000 | Hassan | B64C 23/04 244/130 |
| 6,109,566 | A * | 8/2000 | Miller | B64C 23/005 244/130 |
| 6,123,145 | A * | 9/2000 | Glezer | B64C 21/08 165/104.33 |
| 6,471,477 | B2 * | 10/2002 | Hassan | B64C 23/04 244/130 |
| 7,527,086 | B2 * | 5/2009 | Wang | F15D 1/08 165/104.31 |
| 7,980,516 | B2 * | 7/2011 | Birchette | F04C 21/002 244/207 |

(Continued)

*Primary Examiner* — Devon Kramer
*Assistant Examiner* — Benjamin Doyle
(74) *Attorney, Agent, or Firm* — Felix L. Fischer

(57) ABSTRACT

A synthetic vacuum generator has a case enclosing an interior cavity with an aperture through the case in communication with the cavity. A piston and a check valve are mounted in the case in fluid communication with the cavity and the aperture. The piston and check valve are configured with symbiotic resonant response to establish an outflow there through and inducing an inflow through the aperture upon reciprocation of the piston at a predetermined frequency.

20 Claims, 4 Drawing Sheets

(56) References Cited

U.S. PATENT DOCUMENTS

| | | | | |
|---|---|---|---|---|
| 8,083,157 | B2 * | 12/2011 | Arik | F23D 14/48 239/102.1 |
| 8,937,424 | B2 | 1/2015 | Griffin et al. | |
| 2002/0114716 | A1 * | 8/2002 | Takagi | F04B 11/0008 417/413.2 |
| 2003/0173832 | A1 * | 9/2003 | Hassan | B64C 21/02 310/12.01 |
| 2004/0013548 | A1 * | 1/2004 | Seto | F04B 43/046 417/505 |
| 2004/0018100 | A1 * | 1/2004 | Takagi | F04B 49/065 417/322 |
| 2007/0205853 | A1 * | 9/2007 | Taya | B64C 21/02 335/205 |
| 2007/0267940 | A1 * | 11/2007 | Wright | F04B 43/04 310/311 |
| 2010/0054973 | A1 * | 3/2010 | Arik | F04B 43/095 417/437 |
| 2014/0271277 | A1 * | 9/2014 | Whalen | F04B 43/046 417/413.2 |
| 2015/0101886 | A1 * | 4/2015 | Griffin | F01N 1/02 181/269 |
| 2015/0104310 | A1 * | 4/2015 | Griffin | B64C 21/08 416/1 |
| 2016/0333871 | A1 * | 11/2016 | Griffin | F04B 37/14 |
| 2017/0056913 | A1 * | 3/2017 | Griffin | B05B 17/0653 |

* cited by examiner

SYNTHETIC VACUUM GENERATOR

BACKGROUND INFORMATION

Field

Embodiments of the disclosure relate generally to the field of synthetic actuators for fluidic effects and more particularly to a device having a cavity with a primary aperture and check valve, employing a piston to energize fluid within the cavity for flow through the check valve inducing a pressure reduction relative to the primary aperture creating a synthetic vacuum.

Background

Fluidic jets including synthetic jets are employed for control of flow on various aerodynamic surfaces. Boundary layer control for drag reduction to increase fuel efficiency and for aerodynamic controls on flight vehicles as well as turbulence reduction for such applications as improved aero-optical performance of electro-optical turrets.

It is also well known that boundary layer control may be accomplished by vacuum orifices on the controls or flight surfaces. Laminar flow separation can be delayed or eliminated with the use of properly placed vacuum "sinks". The most prevalent existing solution for creation of vacuum at the orifices is to connect tubes to a centrally located vacuum pump. Vacuum pumps are often heavy and tubing is cumbersome. Highly complex vacuum pumping and routing systems from surface orifices have been employed in prior art systems to provide desired vacuum "point sinks" for boundary layer control. Investigations of improved efficiency fluidic and synthetic jets designed to impart energy into boundary layer airflow over aerodynamic surfaces revealed new and unexpected results. During test and evaluation of such new synthetic and fluidic jets for use in boundary layer control, it was unexpectedly discovered that under certain conditions, instead of an expected outward jet, a vacuum could be established.

It is therefore desirable to provide new structures and methods that can establish a vacuum source for boundary layer control which improves efficiency, lowers structural weight, and alleviates the complexity of current vacuum systems.

SUMMARY

Embodiments disclosed herein provide a synthetic vacuum generator having a case enclosing an interior cavity with a primary aperture through the case in communication with the cavity. A piston and a check valve are mounted in the case in fluid communication with the cavity and the primary aperture. The piston and check valve are configured with symbiotic resonant response to establish an outflow there through and inducing an inflow through the primary aperture upon reciprocation of the piston at a predetermined frequency.

The embodiments disclosed provide a method for generation of a synthetic vacuum by inserting a piston into a cavity in a case having a primary aperture. An exhaust aperture in the case is resiliently sealed with a check valve. The piston is then reciprocated at a frequency to establish symbiotic resonant response between the piston and check valve thereby creating a synthetic vacuum at the primary aperture.

The features, functions, and advantages that have been discussed can be achieved independently in various embodiments of the present disclosure or may be combined in yet other embodiments further details of which can be seen with reference to the following description and drawings.

DETAILED DESCRIPTION

Embodiments disclosed herein provide a synthetic vacuum generator employing a case having an enclosed cavity with a piezo electrically activated piston operatively engaged in the case in fluid communication with the cavity. A check valve operatively engaged in the case in fluid communication with the cavity is resonantly activated by the piston to create a fluid inflow into the cavity through a primary aperture in the case.

Figure 1:
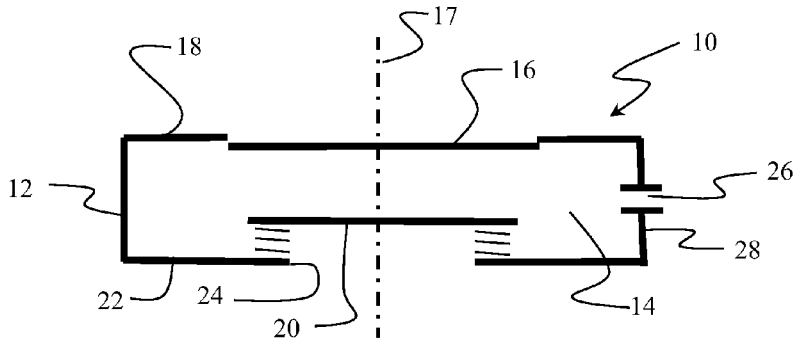
FIG. 1 is a schematic diagram representing an embodiment of the synthetic vacuum generator.

Referring to the drawings, FIG. 1 shows a schematic representation of a cross section of the synthetic vacuum generator 10. A case 12 encloses a cavity 14. A piston 16 is mounted through an upper wall 18 of the case 12 for reciprocating motion on an axis 17. A check valve 20 is mounted in a lower wall 22 of the case 12 resiliently sealing an exhaust aperture 24. A primary aperture 26 is present in a side wall 28 of the case 12. Sizing of the piston, check valve 20 and associated exhaust aperture 24, and the primary aperture 26 will be described in greater detail subsequently.

Figure 2A:
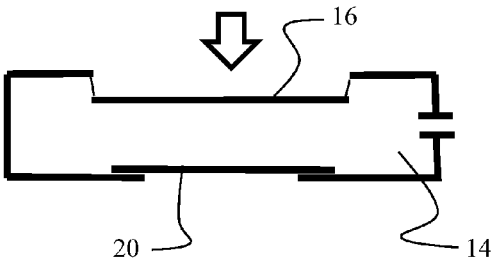
FIGS. 2A and 2B demonstrate low frequency response of the piston and check valve.
Figure 2B:
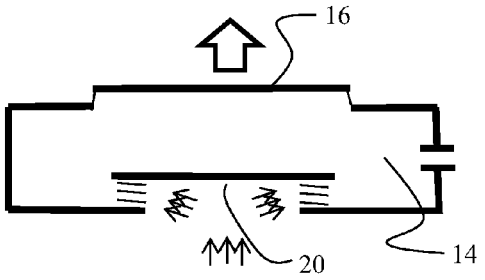

In conventional low frequency reciprocation of the piston 16 in the configuration as shown, the check valve 20 would close when the piston 16 was reciprocated downward and result in a compression of the air in the cavity 14 as shown in FIG. 2A and open when the piston 16 was reciprocated upward allowing air to enter through the check valve 20 as shown in FIG. 2B.

Figure 3A:
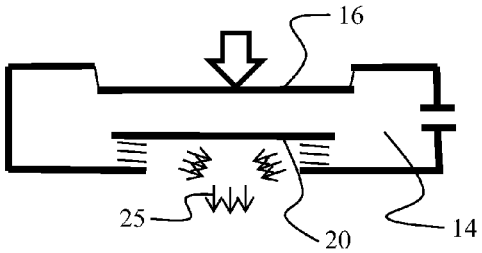
FIGS. 3A and 3B demonstrate high frequency symbiotic response of the check valve and piston.

However, with higher frequency operation of the piston 16 with a piezo electric actuator, which will be described subsequently, at a predetermined frequency it has been demonstrated that a cooperative resonance between the piston and check valve may be established where the check valve moves inward into the cavity as the piston move inward into the cavity, defined herein as symbiotic motion or symbiotic resonant response of the check valve and piston. As shown in FIG. 3A, on the downstroke of the piston 16, the check valve 20 moves inward (into the cavity 14) as the piston 16 moves inward (into the cavity 14), providing a path for the airflow to exit the cavity 14 through exhaust aperture 24 as represented by the arrows 25.

Figure 3B:
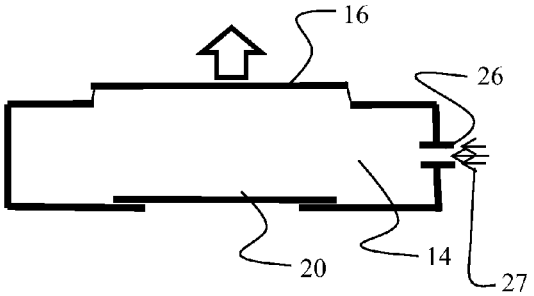

As shown in FIG. 3B, on the upstroke of the piston 16, the check valve 20 moves outward (sealing the cavity 14) as the piston moves outward (relative to the cavity 14), closing the check valve and inducing airflow through the primary aperture 26 as represented by arrows 27. The result of the symbiotic resonance of the piston and check valve provides a diffuse outflow though the exhaust aperture 24 of the check valve 20 with the symbiotic resonant positioning of the piston and check valve consistent with FIG. 3A and a significant, unpredicted, and unexpected inflow (synthetic vacuum) through the primary aperture 26 with the symbiotic resonant positioning of the piston and check valve as shown in FIG. 3B. The synthetic vacuum produced by the symbiotic resonance of the piston and check valve is an unexpected synergistic effect of control of the piston actuation to excite the response of the check valve. During investigations into whether more efficient synthetic jets could be designed and built, using certain types, sizes, positions, and arrangements of check valves in the synthetic jets, this synergistic response of the check valve was discovered. Under the conditions, constructions, and arrangements described here, the unexpected behavior of the check valve enables the inflow 60, and establishes the new synthetic vacuum.

Figure 3C:
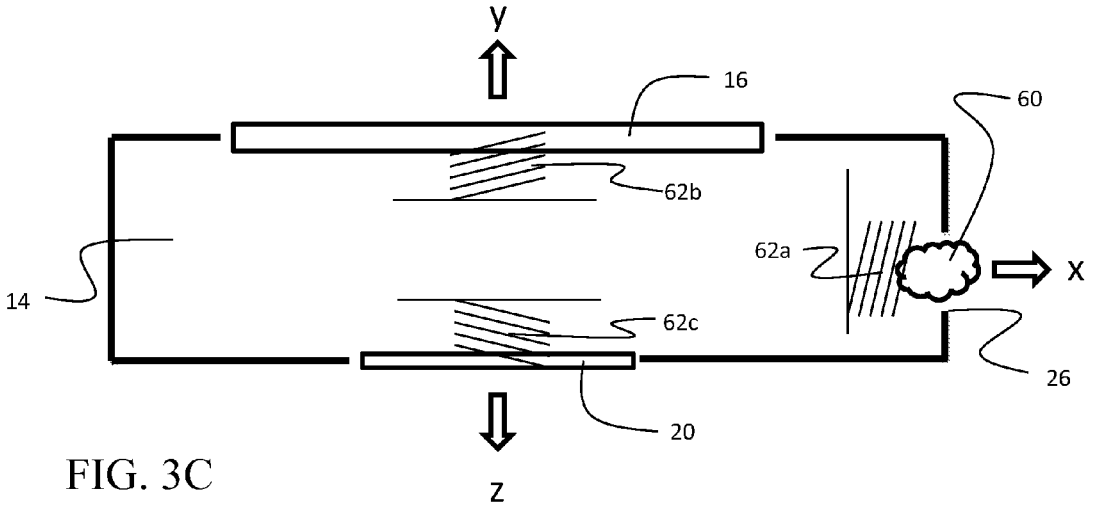
FIG. 3C demonstrates the relative motion of the piston, check valve and air mass.

Motion of the air mass (represented schematically as element 60, FIG. 3C) in the primary aperture 26, is a result of the piston 16 and check valve 20 altering the volume of the cavity 14. The piston 16 is configured to have an outward motion that increases the volume and an inward motion that decreases the volume as shown in FIG. 3C. If the mass of each of these quantities and the stiffness arising from the suspension of the piston and the suspension of the check valve and the air spring for the primary mass (represented schematically as spring 62*a*), piston (represented schematically as spring 62*b*) and check valve (represented schematically as spring 62*c*) are considered, the coupled equations of motion can be derived that relate motions to each other and to the input force on the piston.

A transfer function that may be employed for modeling the behavior of the synthetic vacuum generator relative to properties of the piston 16, check valve 20 and primary aperture 26 for the desired symbiotic resonant response may be characterized for an exemplary embodiment by $$\begin{bmatrix} m_h & 0 & 0 \\ 0 & m_p & 0 \\ 0 & 0 & m_v \end{bmatrix} \begin{Bmatrix} \ddot{x} \\ \ddot{y} \\ \ddot{z} \end{Bmatrix} + \begin{bmatrix} k_h & k_{12} & k_{13} \\ k_{21} & k_p & k_{23} \\ k_{31} & k_{32} & k_v \end{bmatrix} \begin{Bmatrix} x \\ y \\ z \end{Bmatrix} = \begin{Bmatrix} 0 \\ F \\ 0 \end{Bmatrix}$$

where $m_h$ is the mass of the air in the primary aperture, $m_p$ is the mass of the piston and $m_v$ is the mass of the valve and $k_h$, is the stiffness of air mass due to the cavity volume, $k_p$ is the stiffness of the suspension of the piston and $k_v$ is the stiffness of the springs (or resilience) urging sealing of the check valve.

The values $k_{ij}$ are the coupling between each of the resonant systems which are the piston vibrating on its suspension and the valve vibrating on its support springs as in the block diagram embodiment of FIG. 3C. Here, the X, Y, Z "double-dot" matrix represents the respective second derivatives of positions, or the accelerations of the air mass 60 ("X"), the piston 16 ("Y"), and the valve 20 ("Z"). These X, Y, Z, values are unknowns, where "X" is an unknown that represents the acceleration of outward motion of the air mass 60 (the resultant synthetic vacuum represented by negative values of X), "Y" is an unknown variable that represents the acceleration outward motion of the piston 16, and "Z" is an unknown that represents the acceleration of outward motion of the valve 20. Note that the inward motion of the air mass 60 from the resulting synthetic vacuum was an unexpected result that was discovered during investigations into designing more efficient positive pressure, synthetic jets. During testing and evaluation, it was revealed that a synthetic jet became a synthetic vacuum, as is described herein.

The values for all of the m and k coefficients are functions of the area of the primary aperture $s_h$ the area of the piston, $s_p$, and the opening area of the check valve, $s_v$.

When the values are set to $k_h$=beta*sh$^2$; (the product of the bulk modulus divided by cavity volume and the primary aperture area squared)

$k_{12}$=beta*sp*sh; (the product of the bulk modulus divided by cavity volume, the piston area and the primary aperture area)

$k_{13}$=beta*sv*sh; (the product of the bulk modulus divided by cavity volume, the check valve opening area and the primary aperture area)

$k_{21}$=beta*sp*sh; (the product of the bulk modulus divided by cavity volume, the piston area and the primary aperture area)

$k_p$=beta*sp$^2$+$k_p$stiff; (the product of the bulk modulus divided by cavity volume and the piston area squared added to the piston suspension stiffness)

$k_{23}$=beta*sv*sp; (the product of the bulk modulus divided by cavity volume, the check valve area and the piston area)

$k_{31}$=beta*sv*sh; (the product of the bulk modulus divided by cavity volume, the check valve opening area and the primary aperture area)

$k_{32}$=beta*sv*sp; (the product of the bulk modulus divided by cavity volume, the check valve area and the piston area)

Figure 4:
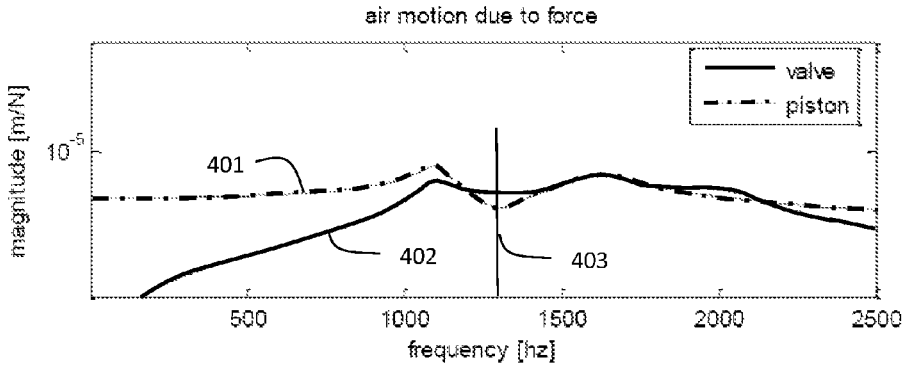
FIG. 4 is a graphical representation of the force at varying frequency inducing motion of the piston and check valve based on a representative transfer function.
Figure 5:
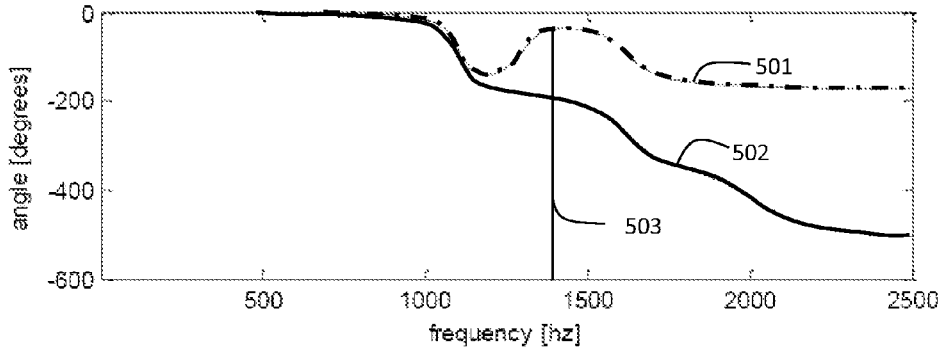
FIG. 5 is a graphical representation of the phase angle with varying frequency of the piston and check valve.

$k_v$=beta*sv$^2$+$k_v$stiff; (the product of the bulk modulus divided by cavity volume and the check valve opening area squared added to the valve suspension stiffness)

where beta is the bulk modulus divided by cavity volume $k_p$stiff=1/8.7e-5*4.4*39.4; the piston suspension stiffness with units of N/m $k_v$stiff=2000; the valve suspension stiffness with units of N/m sp=pi*(1.22/39.4)$^2$; the piston area with units of m$^2$ sh=0.04/39.4*2/39.4; the primary aperture area with units of m$^2$ sv=sh*0.05; the check valve opening area with units of m$^2$ vol=0.06/39.4*sp; the cavity volume with units of m$^3$ $m_p$=pi*1.22^2*0.125*0.1/2.2; mass of the piston in units of kg $m_a$=sh*0.02*1.2; mass of air in the cavity in units of kg $m_v$=$m_p$/1000; mass of the check valve in units of kg The resulting transfer function relating the motion of the check valve to the motion of the piston is shown in FIGS. 4 and 5. For the embodiment disclosed and modeled, the effective stiffness of the piston is approximately a factor of 10 greater than the stiffness of the valve.

As seen in FIG. 4, the magnitude of the displacement per unit of applied force for the piston 16, shown as trace 401, and check valve 20, shown as trace 402, varies with frequency and has a minimum for the piston at approximately 1300 Hz, which is highlighted in this FIG. 4 by notation line 403. The phase relationship of the motion of the piston and check valve seen in FIG. 5 demonstrates the symbiotic resonant response. At low frequencies, the piston phase angle, represented in trace 501, is approximately 0° the check valve phase angle, represented in trace 502, is also approximately 0° demonstrating the expected reaction as described with respect to FIGS. 2A and 2B.

If the resonant frequency of the valve is tuned so that it is slightly above the ~1300 Hz resonant frequency of the piston, which is illustrated in this FIG. 5 by notation line 503, the valve's motion is in phase with the motion of the piston. Since the motion directions are defined as outward, this means the valve moves into the cavity when the piston moves into the cavity and the valve moves out sealing the cavity, when the piston moves outward with respect to the cavity.

The symbiotic motion of the piston and check valve, the check valve moving into the cavity, providing flow through the exhaust port, as the piston is moving into the cavity and the check valve moving outward with respect to the cavity, sealing the cavity, while the piston is moving outward with respect to the cavity results in a reduced pressure in the cavity for inflow through the primary aperture as previously described with respect to FIGS. 3A and 3B. The resonant frequency of ~1300 Hz provides the predetermined frequency for the exemplary embodiment to establish the symbiotic resonant response and symbiotic motion of the piston and check valve to create synthetic vacuum at the primary aperture. The aperture also keeps the valve from moving at low frequencies, as evidenced by the steep drop in the motion of the valve with decreasing frequency.

Figure 6:
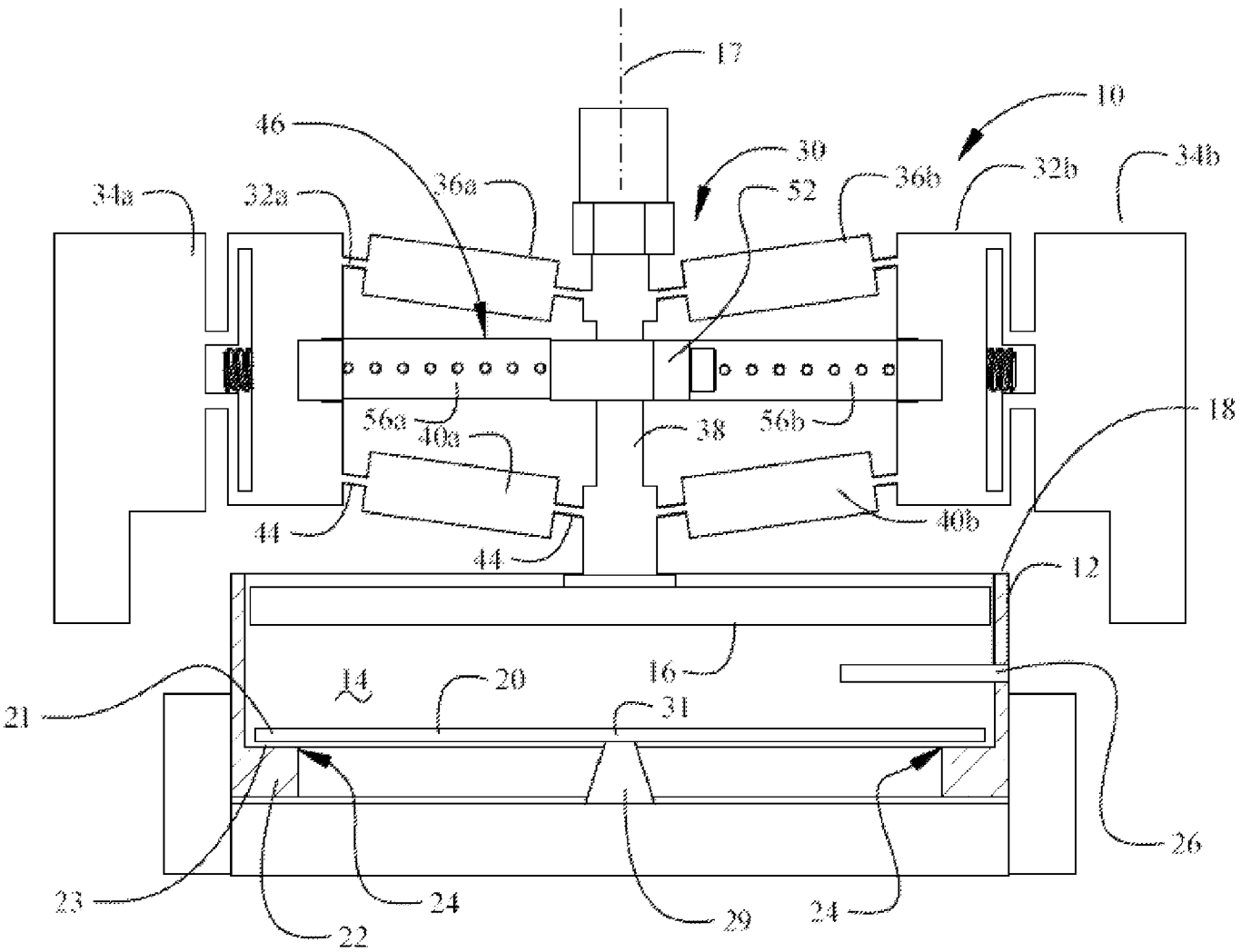
FIG. 6 is a side view of an exemplary embodiment of the synthetic vacuum generator with the case cut-away and sectioned in part to show the piston and check valve arrangement; and, FIG. 7 is a flow chart of a method for creation of a synthetic vacuum employing a piston with resonant check valve providing reduce pressure with respect to an orifice.

FIG. 6 shows an exemplary embodiment of the synthetic vacuum generator 10. The case 12 incorporates the primary aperture 26 in a side wall and piston 16 and check valve 20 are contained within cavity 14 which is cylindrical in the embodiment shown. In the exemplary embodiment, the check valve 20 is a disc shaped diaphragm having a circumferential portion 21 engaged on a step 23 of the lower wall 22 of the case 12 surrounding the exhaust aperture 24. The diaphragm of check valve 20 is constrained at a center point 31 by a support 29 engaged to the case 12. In this configuration, the check valve 20 operates comparable to a Bellville or umbrella valve as the diaphragm resiliently flexes to open or seal the circumferential portion 21 on the step 23. The material of the valve itself effectively provides the spring or stiffness for the desired symbiotic resonant response with the piston. In alternative embodiments, a cantilever reed valve or similar structure may be employed. The direction of reciprocation of the piston 16 and check valve 20 moves substantially longitudinally along the reciprocating axis 17 of the piston 16.

An amplification structure frame 30 for piezoelectric actuation of the piston 16 is attached to the case 12. Laterally spaced flexing end beams 32*a* and 32*b* support the frame 30 from attachment brackets 34*a* and 34*b* which are attached to the case 12. A first pair of opposing actuation beams 36*a* and 36*b* extend angularly from the end beams 32*a* and 32*b*, respectively, to suspend a center shaft 38. A second pair of actuation beams 40*a* and 40*b*, which are spaced longitudinally from the first actuation beam pair 36*a*, 36*b*, extend angularly from the end beams 32*a* and 32*b* to the center shaft 38.

Actuation beams 40*a* and 40*b* are parallel to actuation beams 36*a* and 36*b*, extending from the end beams 32*a* and 32*b* at the same relative extension angle. The actuation beams are interconnected to the end beams and center shaft with flexible joints 44. For the embodiment shown, the joints 44 are flexible webs machined or etched between the end beams and actuation beams and the center shaft and actuation beams. In alternative embodiments, pinned connections may be employed. The components of the amplification structure frame 30 may be fabricated from aluminum (an example embodiment employs 2024 aluminum), titanium, beryllium or beryllium alloys such as beryllium copper, steel or carbon fiber reinforced plastics.

A piezoceramic actuation assembly 46 provides the piezo electric actuator for the amplification structure frame 30 and extends between the end beams 32*a* and 32*b* centered intermediate the first pair of actuation beams 36*a*, 36*b* and second pair of actuation beams 40*a*, 40*b*. Activation of piezoelectric elements in the actuation assembly 46 provides a first condition with lateral extension or second condition with lateral contraction of the assembly which, in turn increases or decreases the lateral distance between the end beams.

An increase in the lateral distance of the end beams to a first relative lateral position (relative to the first condition) results in a reduction in angle to a first extension angle of the actuation beam pairs while a decrease in the lateral distance to a second relative lateral position (relative to the second condition) results in an increase in the angle to a second extension angle. The varying extension angle of the actuation beam pairs creates longitudinal motion of the center shaft 38 along axis 17 for reciprocation of the piston 16 with an amplification of the relative distance of the center shaft between a first longitudinal position at the first extension angle and a second longitudinal position at the second extension angle.

For the embodiment shown, the piezoceramic actuation assembly 46 operates orthogonally to the center shaft 38 on a non-interference basis. For the embodiment shown in FIG. 6, this is accomplished with a collar 52 having an aperture through which the center shaft 38 extends. Two piezoceramic stacks 56*a* and 56*b* extend oppositely from the collar 52 to the end beams 32*a* and 32*b* connecting to the end beams at an outer end and the collar at an opposite inner end. Collar 52 in the embodiment shown in the drawings surrounds the center shaft 38 with interlocking elements.

In alternative embodiments, a collar in the form of a U or semi-cylindrical element which partially surrounds the shaft may be employed. The collar may additionally provide a clearance for the shaft in the aperture, as for the embodiment shown, or closely receive the shaft to act as a guide element to limit shaft lateral deflection. The piezoceramic stacks 56*a* and 56*b* can be formed from low voltage piezoceramic having monolithic ceramic construction made from many thin piezoceramic layers electrically connected in parallel, or in any host of other equally effective arrangements available from many sources that offer piezoelectric/piezoceramic actuators and stacks.

In other alternative embodiments, the piezoceramic actuation assembly may employ a single piezoceramic stack which extends from the end beams through a slot in the center shaft. In any of the embodiments, the attachment brackets may be rigidly mounted to the case and the piezoceramic actuation assembly is maintained in a stationary position while the center shaft is translated longitudinally. This structure significantly reduces the moving mass allowing a higher translation frequency for the shaft 38 to be created by the amplification structure frame 30.

Figure 7:
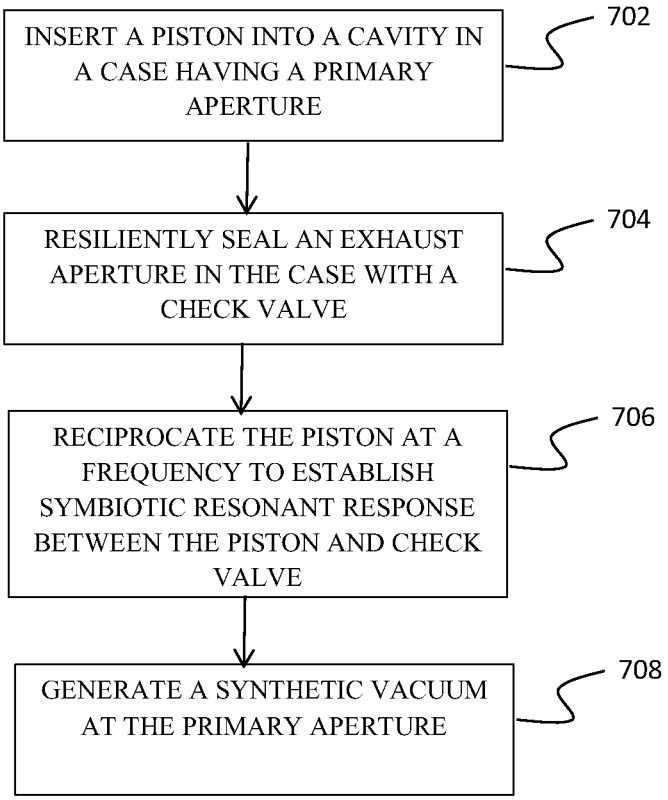

The embodiments provide a method for synthetic creation of a vacuum as shown in FIG. 7 by inserting a piston into a cavity in a case having a primary aperture, step 702. Resiliently sealing an exhaust aperture with a check valve, step 704. Reciprocating the piston at a frequency to establish symbiotic resonant response between the piston and check valve, step 706, thereby creating a synthetic vacuum at the primary aperture, step 708.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A synthetic vacuum generator comprising: a case enclosing an interior cavity with a primary aperture through the case in communication with the cavity; a piston and a check valve mounted on opposite walls of the case and in fluid communication with the cavity and the primary aperture; wherein the piston and check valve are configured to operate with symbiotic resonant response to establish an outflow there through and inducing an inflow through the primary aperture upon reciprocation of the piston at a predetermined frequency.

2. The synthetic vacuum generator as defined in claim 1 wherein the primary aperture is substantially perpendicular to a reciprocating axis of the piston and check valve.

3. The synthetic vacuum generator as defined in claim 1 wherein an area of the check valve opening is less than an area of the primary aperture.

4. The synthetic vacuum generator as defined in claim 3 wherein the area of the check valve opening is less than 0.05 times the area of the primary aperture.

5. The synthetic vacuum generator as defined in claim 1 wherein a mass of the check valve is less than a mass of the piston divided by 1000.

6. The synthetic vacuum generator as defined in claim 1 wherein a stiffness of the piston is a factor of 10 greater than a stiffness of the check valve.

7. The synthetic vacuum generator as defined in claim 1 wherein the piston and check valve operate with a transfer function definable as $$\begin{bmatrix} m_h & 0 & 0 \\ 0 & m_p & 0 \\ 0 & 0 & m_v \end{bmatrix} \begin{Bmatrix} \ddot{x} \\ y \\ z \end{Bmatrix} + \begin{bmatrix} k_h & k_{12} & k_{13} \\ k_{21} & k_p & k_{23} \\ k_{31} & k_{32} & k_v \end{bmatrix} \begin{Bmatrix} x \\ y \\ z \end{Bmatrix} = \begin{Bmatrix} 0 \\ F \\ 0 \end{Bmatrix}$$

where $m_h$ is a mass of air in the cavity, $m_p$ is a mass of the piston, $m_v$ is a mass of the check valve, $k_h$ is a stiffness of the air mass in the cavity, $k_p$ is a stiffness of the piston and $k_v$ is a stiffness of the check valve.

8. The synthetic vacuum generator as defined in claim 7 wherein $k_h$ is a product of a bulk modulus divided by cavity volume and an area of the primary aperture squared; $k_{12}$ is a product of a bulk modulus divided by cavity volume, a piston area and a primary aperture area; $k_{13}$ is a product of the bulk modulus divided by cavity volume, a check valve opening area and the primary aperture area; $k_p$ is a product of the bulk modulus divided by cavity volume and the piston area squared added to a piston stiffness; $k_{23}$ is a product of the bulk modulus divided by cavity volume, the check valve opening area and the piston area; $k_{31}$ is a product of the bulk modulus divided by cavity volume, the check valve opening area and the piston area; $k_{32}$ is a product of the bulk modulus divided by cavity volume, the check valve opening area and the piston area; and, $k_v$ is a product of the bulk modulus divided by cavity volume and the check valve opening area squared added to a valve stiffness.

9. The synthetic vacuum generator as defined in claim 1 wherein the check valve is a Bellville valve.

10. The synthetic vacuum generator as defined in claim 1 wherein the piston is piezo electrically actuated.

11. The synthetic vacuum generator as defined in claim 10 further comprising a center shaft connected to the piston;

a piezoceramic actuation assembly reciprocating the center shaft to establish the symbiotic resonant response.

12. The synthetic vacuum generator as defined in claim 11 further comprising:

an amplification structure frame having laterally spaced flexing end beams, a first pair of opposing actuation beams angularly extending from the end beams, a second pair of opposing actuation beams extending angularly from the end beams, parallel to and longitudinally spaced from the first pair of opposing actuation beams, the center shaft suspended by the first pair of opposing actuation beams and the second pair of actuation beams, and, the piezoceramic actuation assembly extending between the end beams in a non-interference basis with the center shaft.

13. The synthetic vacuum generator as defined in claim 12 wherein the piezoceramic actuation assembly has a first condition placing the end beams in a first relative lateral position with the first and second pair of actuation beams extending at a first angle from the end beams to place the shaft in a first longitudinal position and a second condition placing the end beams in a second relative lateral position with the first and second pair of actuation beams extending at a second angle from the end beams to place the shaft in a second longitudinal position.

14. The synthetic vacuum generator as defined in claim 13 wherein the piezoceramic actuation assembly comprises a pair of piezoceramic stacks each connected at an inner end to a collar and at an outer end to a respective one of the end beams, said center shaft extending through said collar.

15. The synthetic vacuum generator as defined in claim 14 further comprising attachment brackets securing the end beams to the case.

16. A method for creation of a synthetic vacuum comprising: inserting a piston into a cavity in a case having a primary aperture; resiliently sealing an exhaust aperture in the case with a check valve, said check valve and piston on opposing walls of the case; and, reciprocating the piston at a frequency to establish symbiotic resonant response between the piston and check valve thereby generating a vacuum at the primary aperture.

17. The method as defined in claim 16 wherein the step of reciprocating the piston comprises:

attaching the piston to a piezoelectric actuator driving an amplification structure to reciprocate the piston, and, activating the piezoelectric actuator at the frequency.

18. The method as defined in claim 16 wherein the check valve is a Bellville valve.

19. The method as defined in claim 17 wherein the step of attaching the piston comprises:

attaching a first pair of opposing actuation beams angularly extending from flexing end beams, attaching a second pair of opposing actuation beams extending angularly from the end beams, parallel to and longitudinally spaced from the first pair of opposing actuation beams, suspending a center shaft by the first pair of opposing actuation beams and the second pair of actuation beams, and, connecting the piston to the center shaft.

20. The method as defined in claim 19 wherein the step of activating the piezoelectric actuator comprises actuating a piezoceramic actuation assembly extending between the end beams in a non-interference basis with the center shaft.

* * * * *